US010508371B2

(12) United States Patent
Polite

(10) Patent No.: US 10,508,371 B2
(45) Date of Patent: Dec. 17, 2019

(54) THREAD AND NEEDLE PROTECTOR

(71) Applicant: Rosemary Muniz Polite, Divide, CO (US)

(72) Inventor: Rosemary Muniz Polite, Divide, CO (US)

( * ) Notice: Subject to any disclaimer, the term of this patent is extended or adjusted under 35 U.S.C. 154(b) by 173 days.

(21) Appl. No.: 15/706,634

(22) Filed: Sep. 15, 2017

(65) Prior Publication Data

US 2019/0085491 A1 Mar. 21, 2019

(51) Int. Cl.

| | |
|---|---|
| ***D05C 1/06*** | (2006.01) |
| ***D05B 91/16*** | (2006.01) |
| ***A41H 19/00*** | (2006.01) |
| ***D05B 91/12*** | (2006.01) |

(52) U.S. Cl.

CPC ..... *D05C 1/065* (2013.01); *A41H 19/00* (2013.01); *D05B 91/12* (2013.01); *D05B 91/16* (2013.01)

(58) Field of Classification Search

CPC ..... D05C 1/065; D05C 1/06; A41H 19/00; D05B 91/16

See application file for complete search history.

(56) References Cited

U.S. PATENT DOCUMENTS 185,864 A * 1/1877 McMillan ..... D05B 91/12 223/109 R
233,131 A * 10/1880 Auchincloss ..... D05B 91/14 242/139
589,341 A * 8/1897 Dodd ..... 225/62
1,357,874 A * 11/1920 Keckeissen ..... D05B 91/12 223/109 R
2,058,536 A * 10/1936 Waseen ..... D05B 91/14 223/109 R
2,144,199 A * 1/1939 Press ..... D05B 91/14 206/227
2,648,472 A * 8/1953 Gallagher ..... D05B 91/14 223/109 R
2,654,513 A * 10/1953 Spencer ..... D05B 91/14 223/109 R
3,284,025 A * 11/1966 Fridolph ..... B65D 59/04 206/83
3,434,590 A * 3/1969 Laughlin ..... D05B 91/14 206/227
5,490,624 A * 2/1996 Yavitz ..... A01K 89/00 225/34
5,544,831 A * 8/1996 Van Netta ..... D05B 91/16 206/388

(Continued)

FOREIGN PATENT DOCUMENTS

DE 2255158 A1 * 5/1973 ..... A41H 19/00
FR 545287 A * 10/1922 ..... A41H 19/00

*Primary Examiner* — Christopher R Harmon
(74) *Attorney, Agent, or Firm* — Kyle W. Rost

(57) ABSTRACT

A carrier body has a core suitable for receiving a needle tip through one end. A pair of flanges extends outwardly from the core, defining an interflange gap for having thread from the needle wound in the gap. The flange nearer the entry end of the core defines a radial slot receiving thread from the needle eye and passing it into the interflange gap. When the thread is wound on the core, the radial slot prevents having thread from also winding around the needle. The carrier body is configured to enter an open-topped container body in a predetermined position displaying the radial slot and thread at a preselected location for ready viewing of the thread.

4 Claims, 2 Drawing Sheets

(56) References Cited

U.S. PATENT DOCUMENTS 7,850,115 B2 * 12/2010 McCall ..... A01K 97/06
242/125.2

9,723,897 B2 8/2017 Polite

* cited by examiner

THREAD AND NEEDLE PROTECTOR

BACKGROUND OF THE INVENTION

Field of the Invention

The invention generally relates to hand sewing equipment and to a design for a storage container specific to hand sewing. The invention further relates to storage of thread of indeterminate length. The invention also relates to needles combined with spool and implement holders. More specifically, the invention relates to storage holders for thread on a pre-threaded sewing needle.

Description of Related Art

Hand sewing and tailoring of a garment is practiced at preliminary and intermediate fittings, when the assembly is not complete. Likewise, repair is often accomplished by hand sewing. When a hand sewing needle is to be used, often it is necessary to select a desired color of thread and, then, to thread the needle. For some users, using a hand sewing needle in this way is a slow and clumsy process. For many users, threading needles is a least-liked task because it challenges the user's abilities, such as vision to see the eye of the needle, and such as hand function to be steady enough to direct a thread through the eye of the needle.

When a particular task for hand sewing had been completed, the sewing needle may be carrying a substantial length of thread. A sewing needle plus thread is an attractive combination to be kept together, both because it may have subsequent use and because there is no generally acceptable technique for saving useful lengths of thread after removal from a sewing needle. Thus, the combination of hand sewing needle plus appropriate thread remains a useful article, but the creation and storage of this article present a difficulty to the user. Simply saving the thread on a threaded needle among other sewing supplies is unsatisfactory because the associated threads easily become tangled and useless. Kits for remounting the used needle and rewinding the used thread tend to be clumsy and unduly time consuming for use. There has been no reasonable solution to this problem.

My recent U.S. Pat. No. 9,723,897 for Sharps Protector proposes a protective device for sharp pointed pins. The device is formed of a hard, pierce-resistant shell filled with a receptor material that receives the pin points.

It would be desirable to create an easily used presentation, sales, handling, storage and display device for thread on a hand sewing needle that already carries the thread. With respect to presentation, sales, and handling, it would be essential for the intended customer to see the thread so that he can exercise his judgment regarding sufficient matching of colors. At the same time, it would be desirable to protect the thread from pre-sale handling so that the pre-threading of the thread on the needle is not altered.

Similar considerations apply to storage and display, which might take place at the user's home or workplace. Over a period of use, the user might create his own combinations of needle plus thread. It would be desirable for the device to provide the user with an easily used and managed system for storing thread as a component of a threaded needle of the user's assembly. Likewise, it would be desirable to display the user's available thread colors on stored, pre-threaded needles, in such a way that the user can readily survey his inventory of thread stored in combination with a needle to define a stored, threaded needle.

To achieve the foregoing and other objects and in accordance with the purpose of the present invention, as embodied and broadly described herein, the method and apparatus of this invention may comprise the following.

BRIEF SUMMARY OF THE INVENTION

Against the described background, it is therefore a general object of the invention to provide a protective storage and display device for thread and needle as components of a pre-threaded needle, and which also protects the sharp end of the needle, protects the user from insertion errors, and protects the thread from tangling.

According to the invention, a thread and needle protector is formed of a carrier body with front and rear ends. The carrier body has a side periphery configured as a longitudinally elongated shell, extending between the front and rear ends thereof. The shell carries or defines front and rear end transverse flanges extending laterally outwardly from the shell. The two flanges define an interflange gap between them. A shell has a first or forward end disposed transversely to the direction of elongation and has a second or rear and opposite end carrying a longitudinally extending handle. Conventionally, the needle intended for use with the carrier can be of traditional configuration, with a sharp or pointed tip at a forward end and a thread reception eye at the rearward end. At least the front end of the carrier body is open to receive, in use, an inserted needle tip. A fill material occupies the shell behind the first end for receiving and retaining, in use, a needle tip inserted through the first end of the shell. The front transverse flange defines a radially extending slot providing winding management for thread from the needle eye extending through the slot and into the interflange gap. The handle enables the thread to be easily wound around the carrier in the interflange gap. As an example, the carrier can be spun such that the slot spins the thread within the interflange gap, without winding the thread around the needle, itself. Alternatively, the handle enables the protector to be held from outside the interflange gap so that thread can be hand-wrapped around the shell within the gap, once again without wrapping the needle, itself. In either type of wrap, a relative spinning or wrapping takes place to wind thread onto the shell in the interflange gap, without winding the thread onto the needle. References to spinning or wrapping in this context can be taken as synonymous.

According to another aspect of the invention, as described, above, a display carrier and protector for thread and needle is formed of an open-topped container body defining a well. A pair of opposed, spaced apart supports is mounted at the inner periphery of the top of the container body on at least two sides thereof, and extend laterally inwardly to partially close the open top. The spacing between the supports is sufficient to receive a length of needle into the well while the supports are spaced narrowly enough to engage the front transverse flange and thereby limit entry of the carrier into the well such that interflange gap is at least partially above the open topped container body to visually display thread on the shell within the interflange gap.

According to still another aspect of the invention, as described, above, a cover is sized to fit the open-topped container body, wherein the cover is sufficiently transparent that the interflange gap of an inserted carrier is viewable through the cover to enable observation of thread within the interflange gap.

According to a further aspect of the invention, as described, above, the rear end transverse flange is configured with at least two thread lock notches, each facing in an opposite rotary direction, such a clockwise or counterclockwise. Thread wound around the shell within the interflange gap can be caught and pulled back to lock in at least one of the notches, regardless of which rotary direction the thread is wound.

According to a still further aspect of the invention, as described, above, the thread and needle protector and the display carrier are configured with complementary features that cause the thread and needle protector to fit within the display carrier in a predetermined position in which the radially extending slot is aligned with the spacing between the side supports.

According to a more specific aspect of the invention, as described, above, each of the transverse flanges defines a pair of opposed straight edges for resisting rolling of the carrier, wherein the radial slot is on a portion of the front flange between the pair of opposed straight edges, and wherein the open top of the container body is configured with a pair of opposed straight edges spaced to engage the opposed straight edges of the carrier in parallel relationship and with the radial slot disposed between the side supports.

The accompanying drawings, which are incorporated in and form a part of the specification, illustrate preferred embodiments of the present invention, and together with the description, serve to explain the principles of the invention. In the drawings:

DETAILED DESCRIPTION OF THE INVENTION

Figure 7:
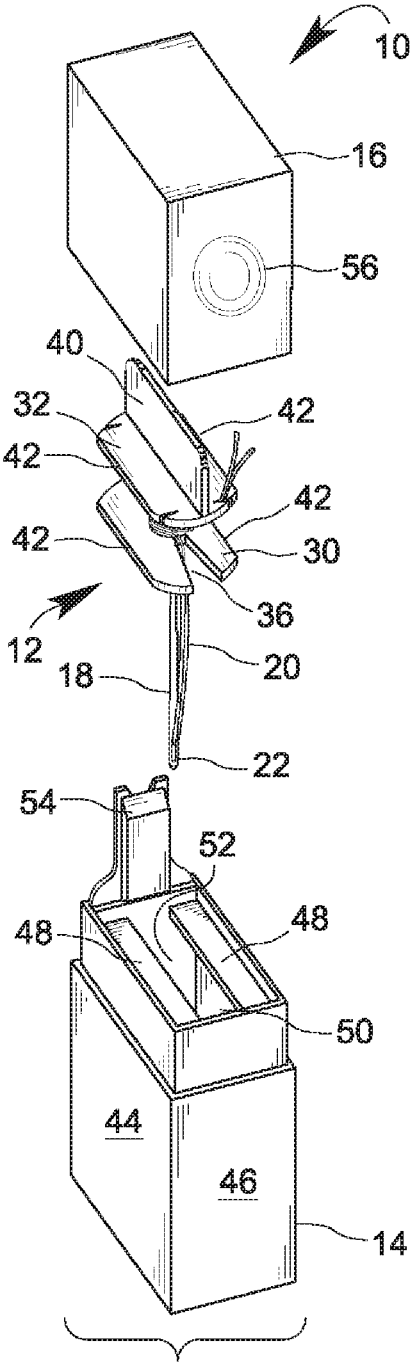
FIG. 7 is an exploded view of the needle and thread protector positioned for insertion of the occupied needle and thread carrier into the open-topped container body and with the cover positioned for application over the needle and thread carrier when received into the container body.
Figure 8:
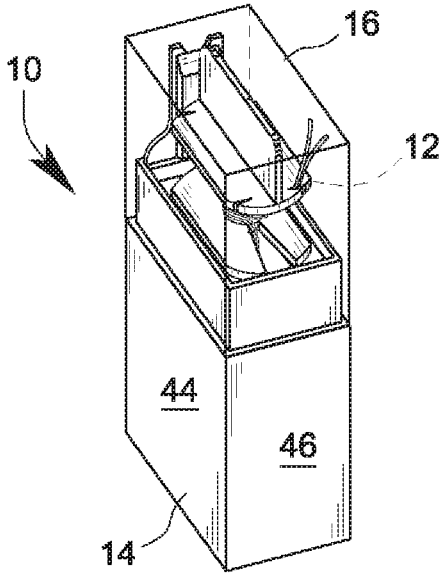
FIG. 8 is an isometric view of the assembled needle and thread protector, with the needle and thread carrier received in the container body, and with cover over the container body.

With reference to FIGS. 7 and 8 of the drawings, the invention is directed to a protector 10 for a hand sewing needle with attached thread. The protector 10 is formed of a needle and thread carrier 12, and a mating display container body 14 that is adapted to receive a needle and thread carrier 12 in a predetermined position. The mating fit between the display container body 14 and the needle and thread carrier 12 outwardly displays the thread that is within the display container body 14. A cover 16 can be applied over the display container body 14. The cover is structured to preserve the view of the thread from outside the display container body 14. Using transparent material to form the cover 16 is a suitable means for preservation of view. Displaying the thread color within the closed container 14 is a desirable technique for presenting protectors 10 with each containing a variously selected thread color for commercial sale. The color display technique also enhances the utility of the protectors 10 for aftermarket storage and retrieval of threaded sewing needles.

With reference to drawing FIGS. 1-6, the needle and thread carrier 12 provides integrated protection of a hand sewing needle 18 and a length of thread 20 that is threaded through the eye 22 of the needle 18. The hand sewing needle 18 may be of typical design, with a sharp tip 24 at one end, which may be regarded as being the forward end. The opposite end of the needle 18, which defines the eye 22, may be regarded as being the rear end. The needle and thread carrier 12 provides a plug of receptor material 26 suited to be pierced by the needle point 24. A suitable plug of receptor material 26 is formed of rubber or a rubber like material.

Figure 1:
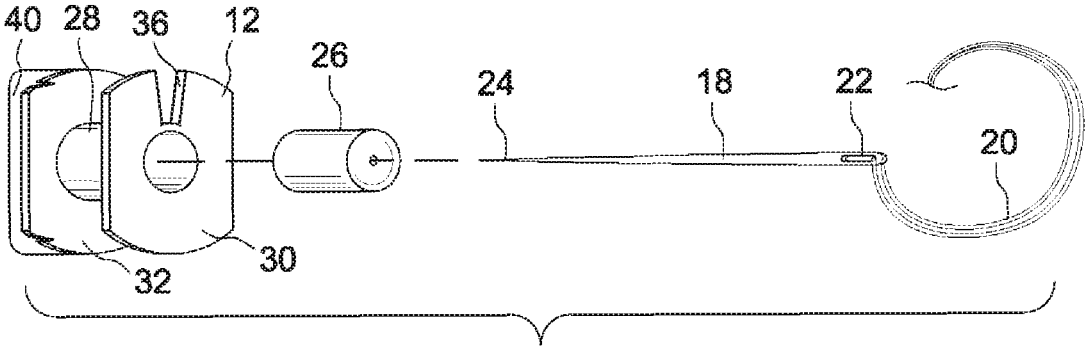
FIG. 1 is an exploded view of a needle and thread carrier, showing the fill material aligned for insertion into the shell and showing an example of a needle and thread positioned to insert the sharp end of the needle into the fill material.
Figure 2:
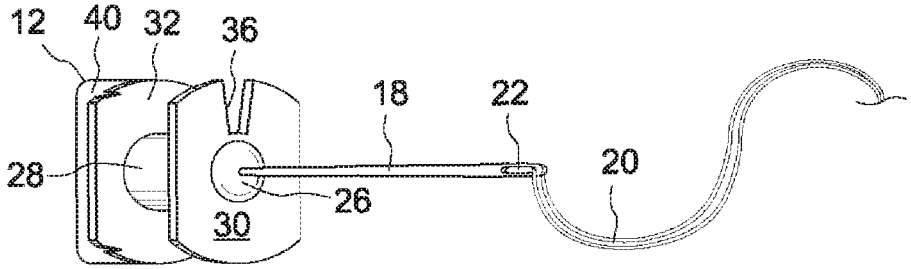
FIG. 2 is an isometric view of the assembled needle and thread carrier of the general design shown in FIG. 1, showing the sharp end of the needle inserted into the fill material.
Figure 3:
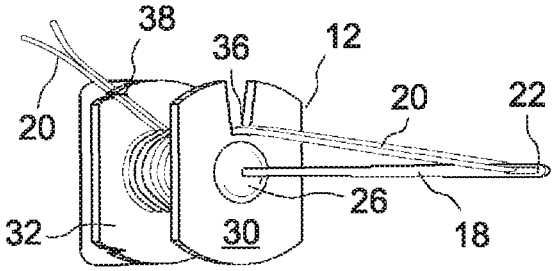
FIG. 3 is an isometric view of the needle and thread carrier of the general design shown in FIG. 2, with a thread from the needle extended through the radial slot and wound on the shell in the interflange gap.
Figure 4:
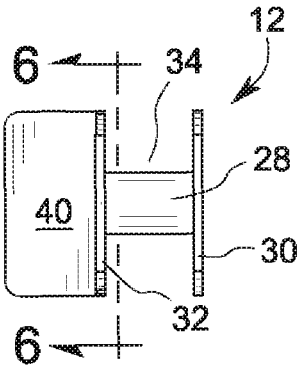
FIG. 4 is a side elevation view of the needle and thread carrier of FIG. 1, showing a side view of the handle behind the rear flange.
Figure 5:
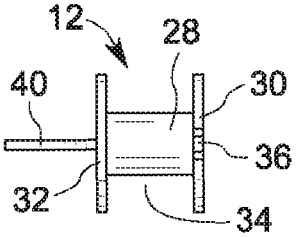
FIG. 5 is top plan view of the needle and thread carrier of FIG. 4, showing a top view of the handle behind the rear flange.

The needle and thread carrier 12 is formed of a shell or cylinder 28 having opposite, first and second ends, wherein the first end may be regarded as being the near end in FIGS. 1-3 or the right-hand end in FIGS. 4 and 5. The second end may be regarded as being the far end in FIGS. 1-3 or the left-hand end in FIGS. 4 and 5.

The needle and thread carrier 12 is configured similarly to a bobbin. The front and rear ends of the shell are joined to respective front end and rear end, outwardly extending, transverse flanges 30,32. The distance between the two flanges, which largely corresponds to the length of shell 28, is regarded as being an interflange gap 34. This gap serves as a thread housing which manages the length of thread that is threaded through the eye 22 of needle 18.

The front flange 30 is equipped with means for localizing the winding of thread in gap 34, so that the thread winds in the gap and not around the needle. A slot 36 is formed in the front flange 30 and extends from the perimeter of the flange toward the shell 28. Conveniently, the slot may be generally radial and may extend from the shell to the perimeter. The slot may have a generally V-shaped contour, where the top of the V shape is at the perimeter. The base of the V shape may be truncated at the shell, such as is shown in FIGS. 1-3.

The thread 20 from needle eye 22 may be tensioned, as shown in FIGS. 3 and 7, and brought into slot 36. Thereafter, the thread may be wound on shell 28 in gap 34. The slot 36 allows the thread to be wound in gap 34 in either direction. Regardless of the direction chosen, the slot prevents the thread from being wound around the needle 18.

Figure 6:
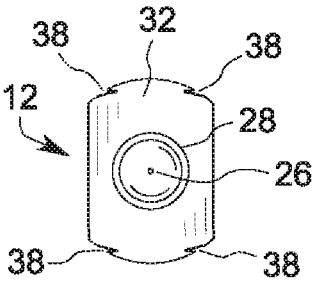
FIG. 6 is a cross-section view taken along the plane through line 6-6 of FIG. 4, showing the shell, fill, and front face of the rear flange.

The rear flange 32 is configured with thread catching or locking notches 38 at two or more locations on its perimeter. One or more of the locking notches 38 are disposed in clockwise direction, while one or more other of the locking notches 38 are disposed in opposite, or counterclockwise direction. By having locking notches extending in both clockwise and counterclockwise directions, the end of the wound thread can be pulled back into an appropriately directed locking notch regardless of the direction of winding. As best shown in FIG. 6, four locking notches 38 are formed in the perimeter of the rear transverse flange, with two locking notches facing in each direction.

A handle 40 is located at the rear of the needle and thread carrier 12, such as on the rear face of the rear transverse flange 32. The handle provides a holding location for supporting the needle and thread carrier 12 while winding thread in interflange gap 34, with the holder's fingers conveniently removed from the gap area. If desired, the handle 40 can be used to rotate the needle and thread carrier 12 during thread winding, or, if desired, the handle 40 can be limited to supporting the needle and thread carrier 12 during manual winding of the thread. Additionally, the location of the handle on the rear end of the needle and thread carrier 12 prevents the needle and thread carrier 12 from being placed on its rear end, effectively preventing a carried needle from resting in an upright, potentially dangerous, exposed position.

The perimeter of the transverse flanges 30, 32 may have varied contours at different sections. A generally round or disc shaped section contour is desirable, particularly at the location of slot 36 on the front flange and at an aligned portion of the rear flange. A disc shaped section contour is likewise desirable at a diametrically opposite section of each flange. Such smooth, circular sections of the perimeter are helpful for guiding thread during winding or unwinding of thread from the interflange gap 34. The transverse flanges also may form sections shaped as opposed pairs of flat or straight edges 42. These flat edges 42 may be located at approximately a quarter turn rotation from the round contoured sections. Like the round sections, the straight edges are located at diametrically opposite portions of each flange and the locations of straight edges on the pair of flanges are located at aligned sections. Due to the alignment of the flat edges, the needle and thread carrier 12 is limited in its ability to roll. FIG. 6 provides a revealing disclosure of the resulting shape of the needle and thread carrier 12 at the face of flange 32, with flange 30 being nearly identical. According to the orientation shown in this FIG. 6, the carrier body is elongated with relatively greater vertical dimension between curved sections, and is relatively narrower between flat sections at the sides.

The operation of the needle and thread carrier 12 is to insert the sharp front tip 24 of a threaded sewing needle 18 into the fill material 26 from the front of the needle and thread carrier 12, as suggested by the view of FIG. 2. The thread 20 then is pulled toward the tip of the needle 18 and moved into slot 36, as suggested by the view of FIG. 3. Using slot 36 to prevent the thread from winding around the needle 18, the user winds the thread around shell 28 in the interflange gap 34. When the thread has only a short end left unwound, the user catches the short end in an appropriately directed locking notch 38 and pulls the short end back in the opposite direction, securing the short end and thereby securing the entire thread wound on shell 28 in gap 34. FIG. 3 shows the typical result, with the thread 20 wound counterclockwise as viewed from the front of the needle and thread carrier 12. It can be seen that the locking notch 38 securing the end of the thread is at the upper left corner of the rear flange 32. The locking notch opens oppositely to the chosen direction of winding, such that the thread end is pulled clockwise in the locking notch to secure the thread end. In the view of FIG. 6, it can be seen that a second locking notch of the same orientation is located at the lower right of the rear flange, which is considered to be diametrically opposite from the locking notch employed in FIG. 3. With two useful locking notches on the rear flange for either chosen direction of winding, the thread end can be very short for a neat result of the winding.

In FIG. 7, the display carrier 14 is shown to be an open topped container body for receiving and storing the needle and thread carrier 12. The display carrier is elongated from front to rear and narrower from side to side. Thus, the side walls 44 are longer than the end walls 46. A pair of opposed supports 48 is arranged with a support 48 positioned along each elongated side wall 44 of the display carrier 14, located slightly below the open top edge. A space 50 between the supports 48 is of sufficient width to pass a needle 18 into the well 52 below the supports 48, but the spacing is less than the narrow width of the front flange 30. However the narrow width of the display carrier 14 is slightly wider than the narrow width of the front flange 30.

The supports 48 are spaced below the top lip of the display carrier 14 by a distance approximately equal to the thickness of the front flange 30. Thus, when the needle and thread carrier 12 of FIG. 7 are inserted into the display carrier 14, the needle 18 passes through the space 50 between the supports 48, and the needle enters the well 52. The front flange 30 is wider than the space 50 and comes to rest on the supports 48, with the rear face of front flange 30 approximately level with the open top of the display carrier 14. This spacing of the front flange places interflange gap 34 and any thread wound in gap 34 above the top of the open topped container body 14.

In addition, the orientation of the front flange 30 is with flat sides contained between the longer walk 44 of the of the display carrier 14. This positioning places the slot 36 over space 50, such that the slot 36 faces a narrow end wall 46 of the display carrier. One of the narrow end walls 46 may have an attached thread cutter 54 extending upward from the open top of the display carrier. It would be desirable to face the slot 36 toward the opposite narrow end wall 46 from the thread cutter 54. By this positioning any thread passing through slot 36 or wound around shell 28 will be visible from the narrow end of the display carrier 14 opposite from the thread cutter 54.

A cover 16 can be placed over the display carrier and over the inserted needle and thread carrier 12, as shown in FIG. 8. The cover not only provides protection but also enables a view of the thread 20, which aids the user in evaluating and selecting a color of thread 20 that is available in a pre-threaded needle. To enhance this evaluation, cover 16 is formed from transparent material. As shown in FIG. 8, a transparent cover allows the user to view both the thread in slot 36 and the thread wound around the interflange gap 34. As a further aid to the user, a narrow end wall 56 of the cover may be configured as or with a magnifier 56, FIG. 7, enlarging the image of the thread to assist in visual color identification and visual determination of the available quantity of thread.

The foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be regarded as falling within the scope of the invention as defined by the claims that follow.

What is claimed is:

1. A thread and needle protector for protecting a needle carrying a length of thread, wherein the needle is configured with a needle tip at a front end thereof and a thread reception eye at the rear end thereof and carrying said length of thread, the protector comprising:

a carrier body having front and rear ends and a side periphery configured as a longitudinally elongated shell extending between the front and rear ends of the carrier body, wherein the front end of said shell receives said needle tip;

a needle reception material located within the shell behind the front end thereof for, in use, retaining the received needle tip of said needle engaged in the front end of the shell;

a front transverse flange extending laterally outwardly from the front end of the shell;

a rear transverse flange extending laterally outwardly from the rear end of the shell;

wherein said front and rear transverse flanges define an interflange gap between them;

the front transverse flange defines a slot open at the periphery of the front transverse flange wherein said length of thread extends from the needle eye of the needle engaged in the shell, through said slot and into said interflange gap, whereby winding the thread on the side of the slot facing the interflange gap is localized from winding the thread on the side of the slot facing the needle eye;

and further comprising:

an open-topped container body defining a well; and a pair of spaced apart supports mounted within the container body near the open top thereof and partially closing the open top, wherein the spacing between the supports is sufficiently wide to pass a length of needle into said well, and the spacing between the supports is sufficiently narrow to prevent passage of said front transverse flange, such that said interflange gap is supported at least partially above the open topped container body, visually displaying any thread on said shell within the interflange gap.

2. The thread and needle protector of claim 1, further comprising:

a cover sized to fit said open-topped container body, wherein said cover is for viewing any thread located within the interflange gap.

3. The thread and needle protector of claim 1, wherein:

said the carrier body and said open-topped container body are configured with complementary features that cause the carrier body to fit in the open-topped container body in a predetermined position in which said slot is aligned with the spacing between said side supports.

4. The thread and needle protector of claim 3, wherein:

said front transverse flange has a periphery configured with two opposed straight edges;

said slot is on a portion of the front transverse flange between said two opposed straight edges, and said the open-topped container body is configured with a pair of opposed straight edges spaced to engage said opposed straight edges of the front transverse flange in parallel relationship and with the slot disposed between said side supports.

* * * * *